US006910748B1

(12) United States Patent
Fountain

(10) Patent No.: US 6,910,748 B1
(45) Date of Patent: Jun. 28, 2005

(54) STORAGE CABINET DEVICE AND KIT

(76) Inventor: Mike S. Fountain, 1501-140 Dunlop Street East, Barrie ON (CA) L4M 6H9

( * ) Notice: Subject to any disclaimer, the term of this patent is extended or adjusted under 35 U.S.C. 154(b) by 237 days.

(21) Appl. No.: 10/392,724

(22) Filed: Mar. 20, 2003

(51) Int. Cl.[7] ..... A47F 3/10; A47B 49/00

(52) U.S. Cl. ..... 312/135; 312/305; 211/85.3; 223/85

(58) Field of Search ..... 312/107, 114, 117, 312/125, 128, 135, 305; 223/85; 211/70, 211/85.3, 163

(56) References Cited

U.S. PATENT DOCUMENTS

| | | | | | |
|---|---|---|---|---|---|
| 353,419 | A | * | 11/1886 | Lamson | 312/135 |
| 1,353,974 | A | * | 9/1920 | Smith | 211/85.3 |
| 1,416,566 | A | * | 5/1922 | McCleary | 312/125 |
| 3,537,625 | A | * | 11/1970 | Nuttall | 223/85 |
| 3,762,570 | A | * | 10/1973 | Tobin | 211/85.3 |
| 4,109,794 | A | * | 8/1978 | Samuel et al. | 211/85.3 |
| 4,838,625 | A | * | 6/1989 | Taylor | 312/249.5 |
| 4,946,049 | A | * | 8/1990 | Silverberg | 211/85.1 |
| 5,071,011 | A | * | 12/1991 | Gettig | 211/85.3 |
| D327,381 | | * | 6/1992 | Ross | D6/461 |
| 5,191,984 | A | * | 3/1993 | Kon et al. | 211/115 |
| 5,542,758 | A | * | 8/1996 | Brown | 312/249.2 |
| 6,086,171 | | * | 7/2000 | Ashley et al. | 312/97.1 |

FOREIGN PATENT DOCUMENTS

| | | | |
|---|---|---|---|
| GB | 237803 | * | 8/1925 |

* cited by examiner

*Primary Examiner*—James O. Hansen

(57) ABSTRACT

A storage cabinet device and kit for use in storing and displaying a plurality of clothing items such as neckties scarfs, belts and alike. The device comprises: a base cabinet, a rotation platform, and a vertically elongated tower cabinet. The base cabinet comprises an external framework and a storage drawer unit. The bottom of the rotation platform is attached to top of the base cabinet and the top of the rotation platform is attached to the lower end of the tower cabinet. The tower cabinet comprises four vertically elongated quadrant units and a top plate. The four vertically elongated quadrant units are axially attached adjacent to each other. Each quadrant unit comprising a plurality of vertically stacked cubbyholes. Each cubby hole has interconnected elements comprising a back wall; a first side wall; an axle; a hollow cylindrical roll-up tube; an L-shaped anchor; a recoil spring hub; a recoil spring gear; a pivot pin; and a release lever. The kit comprises the unattached components of the device of the base cabinet, a rotation platform, and a vertically elongated tower cabinet.

15 Claims, 3 Drawing Sheets

STORAGE CABINET DEVICE AND KIT

FIELD OF THE INVENTION

The present invention relates to storage cabinets, more particularly to a storage cabinet device, kit and associated method of using the device for storing and displaying a plurality of clothing items such as neckties, scarves, belts and alike.

DESCRIPTION OF THE PRIOR ART

The need has long existed for storage or support means for a collection of neckties and which would enable a user to have immediate and ready access to any one of a large number of supported neckties. A shortcoming of many known devices is the limited capacity thereof and often times bulky as they take up too much space on a closet door or other location. Further such racks are not used because they are inconvenient to use them. Ties at the front interfere with removal of ties behind them, and often obstruct the vision so that selections cannot be made without removing a number of ties and then replacing all but the one which is selected. The interference of ties with one another on a rack can be overcome by providing greater clearances between the hangers, but this has been difficult to do without making the necktie racks objectionably large and bulky for the number of ties that can be placed in them.

A wide variety of storage devices is currently available on the commercial market and an even larger number of these types of devices are known in the art of storage devices, for example, the necktie holder disclosed by Tobie in U.S. Pat. No. 3,762,570; the necktie rack disclosed by Samuel et al. in U.S. Pat. No. 4,109,794; the tie display assembly disclosed by Silverberg in U.S. Pat. No. 4,946,049; the necktie rack disclosed by Gettig in U.S. Pat. No. 5,071,011; the display or storage rack for neckties and the like disclosed by Kon et al. in U.S. Pat. No. 5,191,984; and the storage shelving unit disclosed by Ross in U.S. Pat. No. D327,381.

While all of the above-described devices fulfill their respective, particular objectives and requirements, the aforementioned patents do not describe a storage cabinet device tower cabinet comprises four vertically elongated quadrant units in which each quadrant unit comprising a plurality of vertically stacked cubby holes having interconnected elements including a back wall; a first side wall; an axle; a hollow cylindrical roll-up tube; an L-shaped anchor; a recoil spring hub; a recoil spring gear; a pivot pin; and a release lever. This combination of elements would specifically match the user's particular individual needs of making it possible to conveniently store and display a plurality of clothing items such as neckties, scarfs, belts and alike. The above-described patents make no provision for a storage cabinet device tower cabinet comprises four vertically elongated quadrant units in which each quadrant unit comprising a plurality of vertically stacked cubby holes having interconnected elements including a back wall; a first side wall; an axle; a hollow cylindrical roll-up tube; an L-shaped anchor; a recoil spring hub; a recoil spring gear; a pivot pin; and a release lever.

Therefore, a need exists for a new and improved storage cabinet device comprising four vertically elongated quadrant units in which each quadrant unit comprising a plurality of vertically stacked cubby holes having interconnected elements including a back wall; a first side wall; an axle; a hollow cylindrical roll-up tube; an L-shaped anchor; a recoil spring hub; a recoil spring gear; a pivot pin; and a release lever. In this respect, the storage cabinet device according to the present invention substantially departs from the conventional concepts and designs of the prior art, and in doing so provides an apparatus primarily developed for the purpose of making it possible to conveniently store and display a plurality of clothing items such as neckties, scarves, belts and alike.

SUMMARY OF THE INVENTION

The present device, kit and method of using, according to the principles of the present invention, overcomes the shortcomings of the prior art by providing a device, kit and method of using which are associated with a storage cabinet device 10 for use in storing and displaying a plurality of clothing items such as neckties 12, scarves, belts and alike. The device comprises: a base cabinet, a rotation platform, and a vertically elongated tower cabinet. The base cabinet comprises an external framework and a storage drawer unit. The bottom of the rotation platform is attached to top of the base cabinet and the top of the rotation platform is attached to the lower end of the tower cabinet. The tower cabinet comprises four vertically elongated quadrant units and a top plate. The four vertically elongated quadrant units are axially attached adjacent to each other. Each quadrant unit comprising a plurality of vertically stacked cubby holes. Each cubby hole has interconnected elements comprising a back wall; a first side wall; an axle; a hollow cylindrical roll-up tube; an L-shaped anchor; a recoil spring hub; a recoil spring gear; a pivot pin; and a release lever. The kit comprises the unattached components of the device of the a base cabinet, a rotation platform, and a vertically elongated tower cabinet. The method of using comprises the steps of affixing, closing, obtaining, inserting, placing, pulling, pushing, rolling, sliding, and slipping.

In view of the foregoing disadvantages inherent in the known type storage cabinet devices now present in the prior art, the present invention provides an improved storage cabinet device, which will be described subsequently in great detail, is to provide a new and improved storage cabinet device which is not anticipated, rendered obvious, suggested, or even implied by the prior art, either alone or in any combination thereof.

To attain this, the present invention essentially comprises a base cabinet, a rotation platform, and a vertically elongated tower cabinet. The base cabinet comprises an external framework and a storage drawer unit. The bottom of the rotation platform is attached to top of the base cabinet and the top of the rotation platform is attached to the lower end of the tower cabinet. The tower cabinet comprises four vertically elongated quadrant units and a top plate. The four vertically elongated quadrant units are axially attached adjacent to each other. Each quadrant unit comprising a plurality of vertically stacked cubby holes. Each cubby hole has interconnected elements comprising a back wall; a first side wall; an axle; a hollow cylindrical roll-up tube; an L-shaped anchor; a recoil spring hub; a recoil spring gear; a pivot pin; and a release lever.

There has thus been outlined, rather broadly, the more important features of the invention in order that the detailed description thereof that follows may be better understood, and in order that the present contribution of the art may be better appreciated.

The invention may also include optional plurality of floor plates. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved storage cabinet device that has all the advantages of the prior art storage cabinet device and none of the disadvantages.

It is another object of the present invention to provide a new and improved storage cabinet device that may be easily and efficiently manufactured and marketed.

An even further object of the present invention is to provide a new and improved storage cabinet device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new storage cabinet device that provides in the apparatuses and methods of the prior art some of the advantages thererof, while simultaneously overcoming some of the disadvantages normally associated therewith.

Even still another object of the present invention is to provide a storage cabinet device tower cabinet comprises four vertically elongated quadrant units in which each quadrant unit comprising a plurality of vertically stacked cubby holes having interconnected elements including a back wall; a first side wall; an axle; a hollow cylindrical roll-up tube; an L-shaped anchor; a recoil spring hub; a recoil spring gear; a pivot pin; and a release lever. This combination of elements makes it possible to conveniently store and display a plurality of clothing items such as neckties, scarves, belts and alike.

Still another object of the present invention is to provide a new and improved kit comprising the unattached components of the device of the a base cabinet, a rotation platform, and a vertically elongated tower cabinet.

Lastly, it is an object of the present invention to provide a new and improved method of using comprises the steps of affixing, closing, obtaining, inserting, placing, pulling, pushing, rolling, sliding, and slipping.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
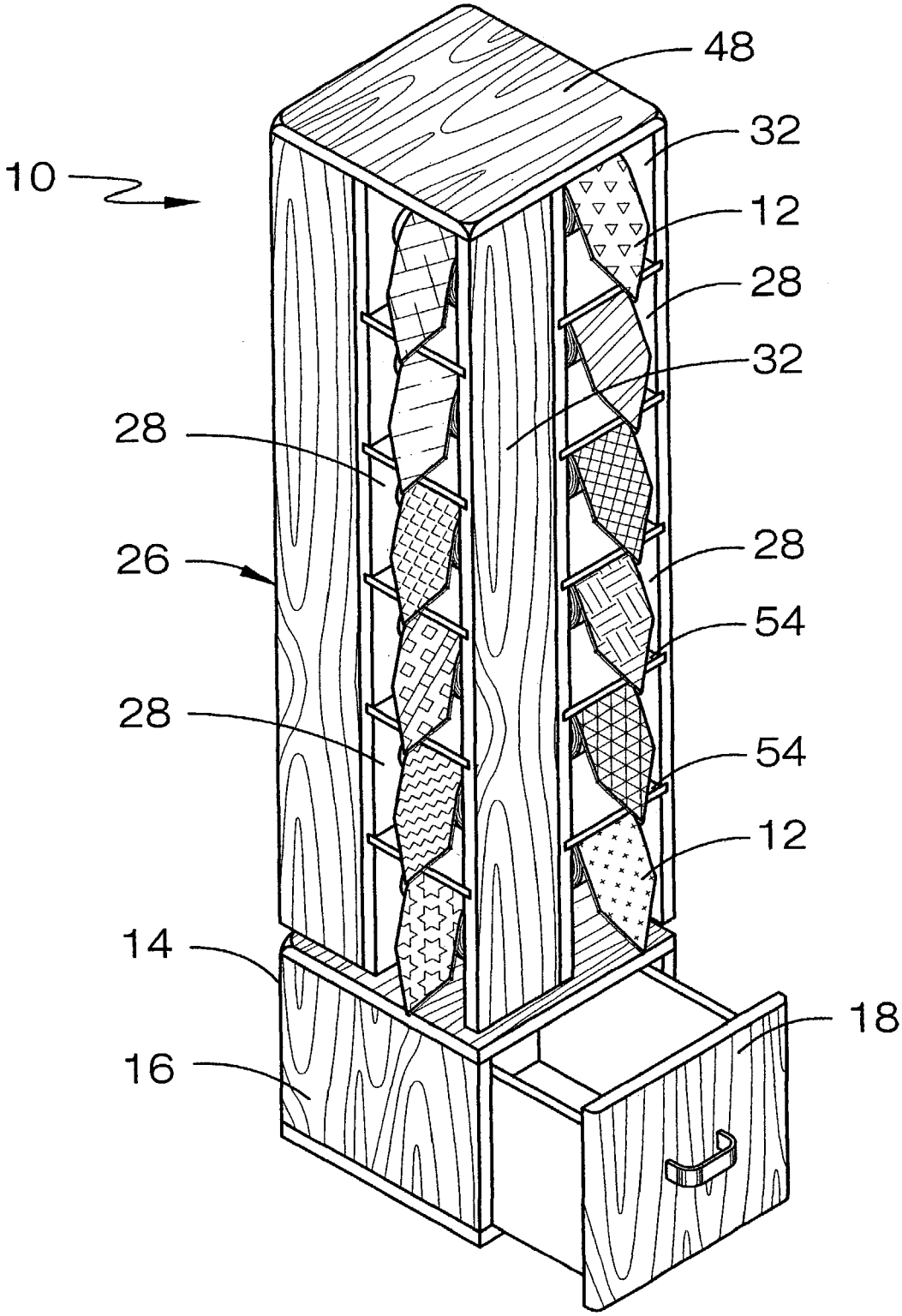
FIG. 1 is a perspective view of a preferred embodiment of the storage cabinet device constructed in accordance with the principles of the present invention.
Figure 2:
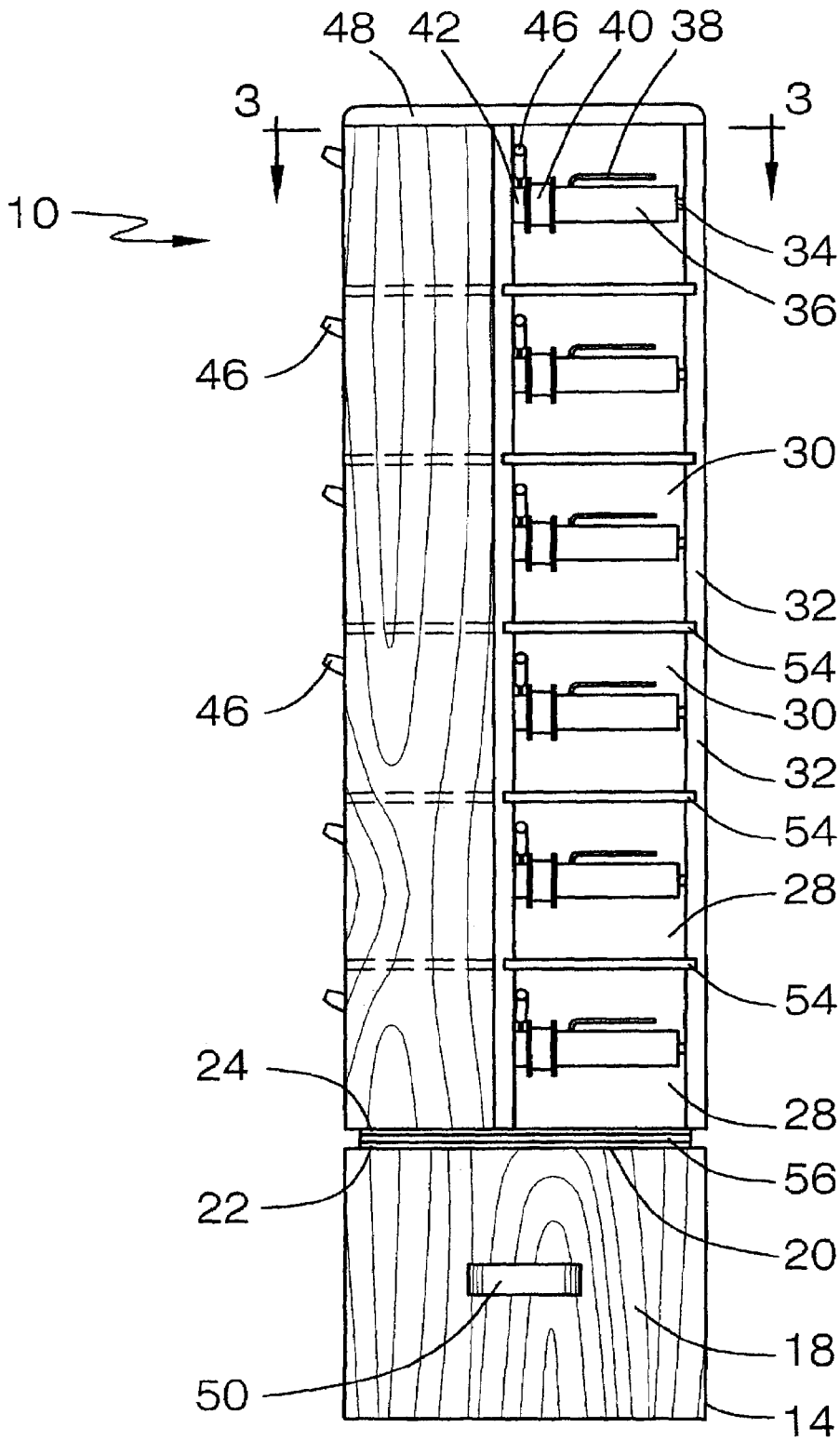
FIG. 2 is a front view of a preferred embodiment of the storage cabinet device of the present invention.
Figure 4:
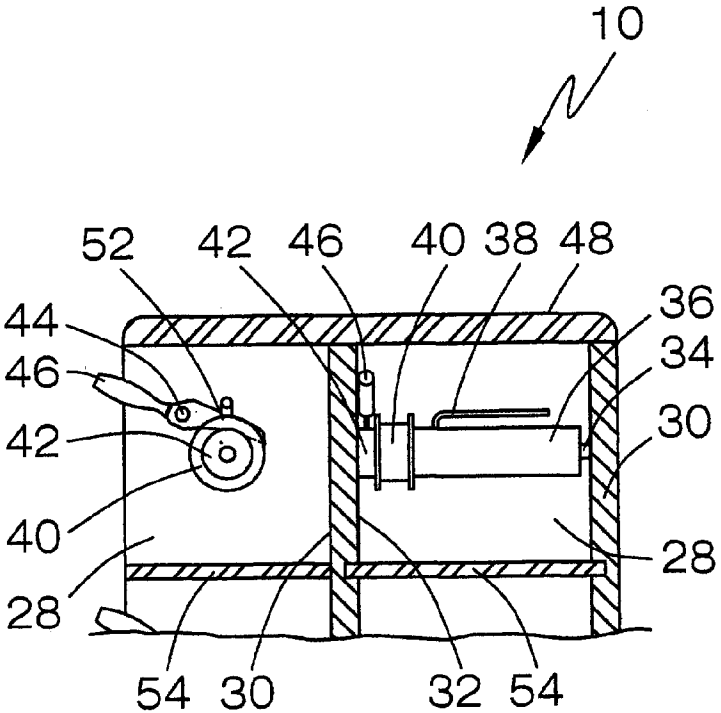
FIG. 4 is a cross sectional side view of a preferred embodiment of the the storage cabinet device of the present invention.
Figure 3:
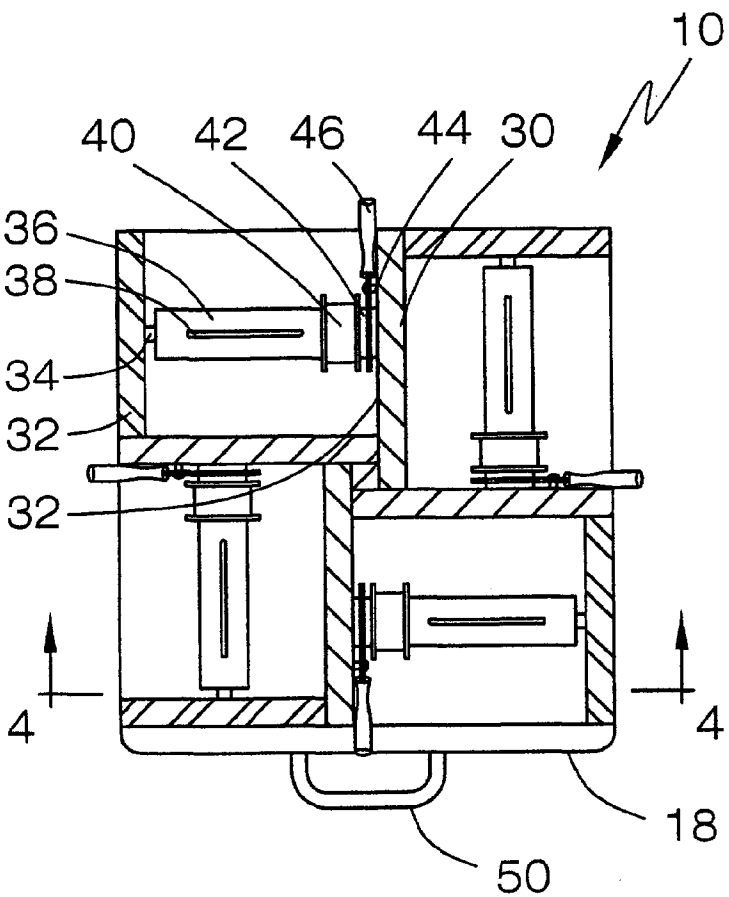
FIG. 3 is a cross sectional top view of a preferred embodiment of the storage cabinet device of the present invention.

Referring now to the drawings, and in particular FIGS. 1 to 4 thereof, one preferred embodiment of the present invention is shown and generally designated by the reference numeral 10. One preferred embodiment of the storage cabinet device 10 for use in storing and displaying a plurality of clothing items such as neckties 12, scarves, belts and alike comprises: a base cabinet 14, a rotation platform 20, and a vertically elongated tower cabinet 26. The base cabinet 14 including: an external framework 16 and a storage drawer unit 18. The external framework 16 having a top, a bottom, a plurality of interconnected sides and an opening, in which the opening defining an entranceway into a centrally disposed interior chamber within the external framework 16. The storage drawer unit 18 is slidably engaged to the external framework 16, wherein a portion of the storage draw being insertable within the centrally disposed interior chamber of the external framework 16. The rotation platform 20 has a bottom element 22 attached to a top element 24, in which the bottom element 22 of the rotation platform 20 is attached to the top of the external framework 16 of the base cabinet 14. The lower end of the tower cabinet 26 is attached to the top element 24 of the rotation platform 20. The tower cabinet 26 including: four vertically elongated quadrant units and a top plate 48. The four vertically elongated quadrant units are axially attached adjacent to each other. Each quadrant unit comprising a plurality of vertically stacked cubby holes 28. Each particular cubby hole 28 in any given quadrant unit comprises: a back wall 30; a first side wall 32; an axle 34; a hollow cylindrical roll-up tube 36; an L-shaped anchor 38; a recoil spring hub 40; a recoil spring gear 42; a pivot pin 44; and a release lever 46. The first side wall 32 is attached to the back wall 30, wherein the exterior surface of an adjacent back wall 30 of a horizontally adjacent cubby hole 28 associated with a vertically adjacent quadrant unit constitutes a second side wall 32 of the particular cubby hole 28, wherein the second side wall 32 of each particular cubby hole 28 is attached to the back wall 30 of each particular cubby hole 28. The axle 34 is attached to the first and second side walls 32. The hollow cylindrical roll-up tube 36 is rotatably attached around the axle 34. The L-shaped anchor 38 is attached to the roll-up tube 36, wherein a substantial portion of the L-shaped anchor 38 is substantially parallel to the roll-up tube 36. The recoil spring hub 40 is attached at one end of the roll-up tube 36, the recoil spring hub 40 rotatably attached around the axle 34. The recoil spring gear 42 is rotatably attached to the recoil spring hub 40, wherein the recoil spring gear 42 is attached around the axle, the recoil spring gear 42 is attached to one of the side walls 32. The pivot pin 44 is attached to the one of the side walls 32. The release lever 46 is pivotally attached to the pivot pin 44, the distal end of the release lever 46 is releaseably attachable to the recoil spring gear 42. The top plate 48 attached to the upper end of the four vertically elongated quadrant units.

The rotation platform 20 may be any commercially known apparatus as long as it is able to allow the tower cabinet to rotate freely around the axis defined by the top of the base cabinet. One preferred configuration of the rotation platform 20 is that the bottom element 22 of the rotation platform 20 is pivotally attached to the top element 24 of the rotation platform 20. This preferred configuration may further comprise a ball bearing joint 56 attached between the top and bottom elements (24 and 22, respectively) of the rotation platform 20. Another preferred configuration of the rotation platform 20 is that the top element 24 of the rotation platform 20 is a spike, wherein the spike is slidably insertable into the hollow orifice of the lower end of the tower cabinet 26, whereby the tower cabinet 26 is freely rotatable around the spike of the top element 24 of the rotation platform 20.

The position of which side the various items, such as the L-shaped anchor 38, the recoil spring hub 40, the recoil spring gear 42, the pivot pin 44, and the release lever 46 may be on either the first side wall 22 or the second side wall 22, depending on the right or left handed preferences of the user as well as on the esthetics of the user. Therefore one preferred configurations of the one of the side walls 32 comprises the first side wall 32 of each particular cubby hole 28. Another preferred configuration of the one of the side walls 32 comprises the second side wall 32 of each particular cubby hole 28.

The shape of the top plate may be any desired design. One preferred configuration of the shape of the top plate 48 is that it has a generally square shape.

An optional handle 50 may be added to the device 10. The handle 50 is attached to the storage drawer unit 18.

An optional plurality of stop pins 52 may be added to the device 10. Each stop pin 52 is attached to the one of the side walls 32 of each particular cubby hole 28, wherein a portion of the distal end of the release lever 46 is connectable to the stop pin 52, whereby the stop pin 52 restricts the rotation of the release lever 46 about the pivot pin 44.

An optional plurality of floor plates 54 may be added to the device 10. Each floor plate 54 is attached to a corresponding first and second side walls 32 of each particular cubby hole 28 except for the lowest stacked cubby hole 28 of the vertically stacked cubby holes 28 of any given quadrant unit.

One embodiment of the kit for assembling a storage cabinet device 10 for use in storing and displaying a plurality of clothing items such as neckties 12, scarves, belts and alike, comprises: a base cabinet 14, a rotation platform 20, and a vertically elongated tower cabinet 26. The base cabinet 14 includes: an external framework 16 having a top, a bottom, a plurality of interconnected sides and an opening, the opening defining an entranceway into a centrally disposed interior chamber within the external framework 16; and a storage drawer unit 18 slidably engaged to the external framework 16, wherein a portion of the storage draw being insertable within the centrally disposed interior chamber of the external framework 16. The rotation platform 20 has a bottom element 22 attached to a top element 24, the bottom element 22 of the rotation platform 20 is attachable to the top of the external framework 16 of the base cabinet 14. The lower end of the tower cabinet 26 is attachable to the top element 24 of the rotation platform 20. The tower cabinet 26 includes: four vertically elongated quadrant units and a top plate 48. The four vertically elongated quadrant units are axially attached adjacent to each other. Each quadrant unit comprises a plurality of vertically stacked cubby holes 28. Each particular cubby hole 28 in any given quadrant unit comprises: a back wall 30; a first side wall 32 attached to the back wall 30, wherein the exterior surface of an adjacent back wall 30 of a horizontally adjacent cubby hole 28 associated with a vertically adjacent quadrant unit constitutes a second side wall 32 of the particular cubby hole 28, wherein the second side wall 32 of each particular cubby hole 28 is attached to the back wall 30 of each particular cubby hole 28; an axle 34 attached to the first and second side walls 32; a hollow cylindrical roll-up tube 36 rotatably attached around the axle 34; an L-shaped anchor 38 attached to the roll-up tube 36, wherein a substantial portion of the L-shaped anchor 38 is substantially parallel to the roll-up tube 36; a recoil spring hub 40 attached at one end of the roll-up tube 36, the recoil spring hub 40 rotatably attached around the axle 34; a recoil spring gear 42 rotatably attached to the recoil spring hub 40, wherein the recoil spring gear 42 is attached around the axle, the recoil spring gear 42 is attached to one of the side walls 32; a pivot pin 44 attached to the one of the side walls 32; and a release lever 46 pivotally attached to the pivot pin 44, the distal end of the release lever 46 is releaseably attachable to the recoil spring gear 42. The top plate 48 is attached to the upper end of the four vertically elongated quadrant units.

The storage drawer unit 18 of the base cabinet 14 of the kit may have an optional handle 50 attached to the storage drawer unit 18.

The tower cabinet 26 of the kit may have an optional plurality of stop pins 52, each stop pin 52 is attached to the one of the side walls 32 of each particular cubby hole 28, wherein a portion of the distal end of the release lever 46 is connectable to the stop pin 52, whereby the stop pin 52 restricts the rotation of the release lever 46 about the pivot pin 44. The tower cabinet 26 of the kit may also have an optional a plurality of floor plates 54, each floor plate 54 is attached to a corresponding first and second side walls 32 of each particular cubby hole 28 except for the lowest stacked cubby hole 28 of the vertically stacked cubby holes 28 of any given quadrant unit. The tower cabinet 26 of the kit may also have a hollow orifice 58 at the lower end of the tower cabinet 26, in which the hollow orifice positioned along the vertical axial center of the tower cabinet 26. The bottom element 22 of the rotation platform 20 of the kit may be pivotally attached to the top element 24 of the rotation platform 20. The top element 24 of the rotation platform 20 may be a spike, in which the spike is slidably insertable into the hollow orifice 58 of the lower end of the tower cabinet 26, whereby the tower cabinet 26 is freely rotatable around the spike of the top element 24 of the rotation platform 20 when the hollow orifice 58 of the tower cabinet 26 envelopes the spike of the top element 24 of the rotation platform 20.

One preferred embodiment of the method of using a kit for assembling a storage cabinet device 10 for use in storing and displaying a plurality of clothing items, the method comprises the steps of affixing, closing, obtaining, inserting, placing, pulling, pushing, rolling, sliding, and slipping. The obtaining step comprises obtaining the kit comprising: a base cabinet 14 including: an external framework 16 having a top, a bottom, a plurality of interconnected sides and an opening, the opening defining an entranceway into a centrally disposed interior chamber within the external framework 16; and a storage drawer unit 18 slidably engaged to the external framework 16, wherein a portion of the storage draw being insertable within the centrally disposed interior chamber of the external framework 16; a rotation platform 20 having a bottom element 22 attached to a top element 24, the bottom element 22 of the rotation platform 20 is attachable to the top of the external framework 16 of the base cabinet 14, wherein the top element 24 of the rotation platform 20 is a spike; a vertically elongated tower cabinet 26, the lower end of the tower cabinet 26 is attachable to the top element 24 of the rotation platform 20, the tower cabinet 26 including: four vertically elongated quadrant units axially attached adjacent to each other, each quadrant unit comprising a plurality of vertically stacked cubby holes 28, wherein each particular cubby hole 28 in any given quadrant unit comprises: a back wall 30; a first side wall 32 attached to the back wall 30, wherein the exterior surface of an adjacent back wall 30 of a horizontally adjacent cubby hole 28 associated with a vertically adjacent quadrant unit constitutes a second side wall 32 of the particular cubby hole 28, wherein the second side wall 32 of each particular cubby hole 28 is attached to the back wall 30 of each particular cubby hole 28; an axle 34 attached to the first and second side walls 32; a hollow cylindrical roll-up tube 36 rotatably attached around the axle 34; an L-shaped anchor 38 attached to the roll-up tube 36, wherein a substantial portion of the L-shaped anchor 38 is substantially parallel to the roll-up tube 36; a recoil spring hub 40 attached at one end of the roll-up tube 36, the recoil spring hub 40 rotatably attached around the axle 34; a recoil spring gear 42 rotatably attached to the recoil spring hub 40, wherein the recoil spring gear 42 is attached around the axle, the recoil spring gear 42 is attached to one of the side walls 32; a pivot pin 44 attached to the one of the side walls 32; and a release lever 46 pivotally attached to the pivot pin 44, the distal end of the release lever 46 is releaseably attachable to the recoil spring gear 42; a hollow orifice at the lower end of the tower cabinet 26, the hollow orifice 58 positioned along the vertical axial center of the tower cabinet 26; and a top plate 48 attached to the upper end of the four vertically elongated quadrant units, wherein the spike of the top element 24 of the rotation platform 20 is slidably insertable into the hollow orifice 58 of the lower end of the tower cabinet 26, whereby the tower cabinet 26 is freely rotatable around the spike of the top element 24 of the rotation platform 20 when the hollow orifice 58 of the tower cabinet 26 envelopes the spike of the top element 24 of the rotation platform 20. The affixing step comprises affixing the bottom element 22 of the rotation platform 20 to the top of the base cabinet 14. The inserting step comprises inserting the spike of the top element 24 of the rotation platform 20 into the hollow orifice 58 of the tower cabinet 26, wherein the obtaining, affixing and inserting steps constitute assembling the device 10. The slipping step comprises slipping the middle portion of a necktie 12 around the L-shaped anchor 38 attached to the roll-up tube 36 of a given cubby hole 28. The pulling step comprises pulling down pivotally the proximate end of the release lever 46 corresponding to the given cubby hole 28 with the necktie 12 slipped around the L-shaped anchor 38, so that the distal end of the release lever 46 unlocks with the recoil spring gear 42 of the given cubby hole 28. The rolling step comprises rolling up a portion of the necktie 12 around the roll-up tube 36 of the given cubby hole 28 while the release lever 46 is lifted up. The pushing step comprises pushing up pivotally the proximate end of the release lever 46 corresponding to the given cubby hole 28 with the rolled up necktie 12 around the L-shaped anchor 38 so that the distal end of the release lever 46 locks with the recoil spring gear 42 of the given cubby hole 28. The sliding step comprises sliding open a portion of the storage drawer unit 18 away from the base cabinet 14. The placing step comprises placing a belt in the slid open storage drawer unit 18 of the base cabinet 14. The closing step comprises closing the storage drawer unit 18 of the base cabinet 14 when the belt is placed in the storage drawer unit 18.

As to the manner of usage and operation of the present invention, the same should be apparent from the above description. Accordingly, no further discussion relating to the manner of usage and operation will be provided.

While a preferred embodiment of the storage cabinet device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or comprising" or the term "includes or variations, thereof, or the them "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combination any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A storage cabinet device for use in storing and displaying a plurality of clothing items selected from the group consisting of neckties, scarves and belts, said device comprising:

a base cabinet including:

an external framework having a top, a bottom, a plurality of interconnected sides and an opening, said opening defining an entranceway into a centrally disposed interior chamber within said external framework; and a storage drawer unit slidably engaged to said external framework, wherein a portion of said storage drawer unit being insertable within said centrally disposed interior chamber of said external framework;

a rotation platform having a bottom element attached to a top element, said bottom element of said rotation platform is attached to the top of said external framework of said base cabinet; and a vertically elongated tower cabinet, the lower end of said tower cabinet is attached to said top element of said rotation platform, said tower cabinet including:

four vertically elongated quadrant units axially attached adjacent to each other, each quadrant unit comprising a plurality of vertically stacked cubby holes, wherein each particular cubby hole in any given quadrant unit comprises:

a back wall;

a first side wall attached to said back wall, wherein the exterior surface of an adjacent back wall of a horizontally adjacent cubby hole associated with a vertically adjacent quadrant unit constitutes a second side wall of said particular cubby hole, wherein said second side wall of each particular cubby hole is attached to said back wall of each particular cubby hole;

an axle attached to said first and second side walls;

a hollow cylindrical roll-up tube rotatably attached around said axle;

an L-shaped anchor attached to said roll-up tube, wherein a substantial portion of said L-shaped anchor is substantially parallel to said roll-up tube;

a recoil spring hub attached at one end of said roll-up tube, said recoil spring hub rotatably attached around said axle;

a recoil spring gear rotatably attached to said recoil spring hub, wherein said recoil spring gear is attached around said rod, said recoil spring gear is attached to one of said side walls;

a pivot pin attached to said one of said side walls; and a release lever pivotally attached to said pivot pin, the distal end of said release lever is releaseably attachable to said recoil spring gear; and a top plate attached to the upper end of said four vertically elongated quadrant units.

2. The device of claim 1 further comprising a handle is attached to said storage drawer unit.

3. The device of claim 1 further comprising a plurality of stop pins, each stop pin is attached to said one of said side walls of each particular cubby hole, wherein a portion of the distal end of said release lever is connectable to said stop pin, whereby said stop pin restricts the rotation of said release lever about said pivot pin.

4. The device of claim 1 further comprising a plurality of floor plates, each floor plate is attached to a corresponding first and second side walls of each particular cubby hole except for the lowest stacked cubby hole of said vertically stacked cubby holes of any given quadrant unit.

5. The device of claim 1 wherein said bottom element of said rotation platform is pivotally attached to said top element of said rotation platform.

6. The device of claim 5 further comprising a ball bearing joint attached between said top and bottom elements of said rotation platform.

7. The device of claim 1 wherein said one of said side walls comprises said first side wall of each particular cubby hole.

8. The device of claim 1 wherein said one of said side walls comprises said second side wall of each particular cubby hole.

9. The device of claim 1 wherein said top plate has a generally square shape.

10. The device of claim 1 wherein each quadrant unit comprising at least three vertically stacked cubby holes.

11. A kit for assembling a storage cabinet device for use in storing and displaying a plurality of clothing items selected from the group consisting of neckties, scarves and belts, said kit comprising:

a base cabinet including:

an external framework having a top, a bottom, a plurality of interconnected sides and an opening, said opening defining an entranceway into a centrally disposed interior chamber within said external framework; and a storage drawer unit slidably engaged to said external framework, wherein a portion of said storage drawer unit being insertable within said centrally disposed interior chamber of said external framework;

a rotation platform having a bottom element attached to a top element, said bottom element of said rotation platform is attachable to the top of said external framework of said base cabinet; and a vertically elongated tower cabinet, the lower end of said tower cabinet is attachable to said top element of said rotation platform, said tower cabinet including:

four vertically elongated quadrant units axially attached adjacent to each other, each quadrant unit comprising a plurality of vertically stacked cubby holes, wherein each particular cubby hole in any given quadrant unit comprises:

a back wall;

a first side wall attached to said back wall, wherein the exterior surface of an adjacent back wall of a horizontally adjacent cubby hole associated with a vertically adjacent quadrant unit constitutes a second side wall of said particular cubby hole, wherein said second side wall of each particular cubby hole is attached to said back wall of each particular cubby hole;

an axle attached to said first and second side walls;

a hollow cylindrical roll-up tube rotatably attached around said axle;

an L-shaped anchor attached to said roll-up tube, wherein a substantial portion of said L-shaped anchor is substantially parallel to said roll-up tube;

a recoil spring hub attached at one end of said roll-up tube, said recoil spring hub rotatably attached around said axle;

a recoil spring gear rotatably attached to said recoil spring hub, wherein said recoil spring gear is attached around said axle, said recoil spring gear is attached to one of said side walls;

a pivot pin attached to said one of said side walls; and a release lever pivotally attached to said pivot pin, the distal end of said release lever is releaseably attachable to said recoil spring gear; and a top plate attached to the upper end of said four vertically elongated quadrant units.

12. The kit of claim 11 wherein said storage drawer unit of said base cabinet having a handle attached to said storage drawer unit.

13. The kit of claim 11 wherein said tower cabinet further comprising a plurality of stop pins, each stop pin is attached to said one of said side walls of each particular cubby hole, wherein a portion of the distal end of said release lever is connectable to said stop pin, whereby said stop pin restricts the rotation of said release lever about said pivot pin.

14. The kit of claim 11 wherein said tower cabinet further comprising a plurality of floor plates, each floor plate is attached to a corresponding first and second side walls of each particular cubby hole except for the lowest stacked cubby hole of said vertically stacked cubby holes of any given quadrant unit.

15. The kit of claim 11 wherein said bottom element of said rotation platform is pivotally attached to said top element of said rotation platform.

* * * * *